United States Patent [19]

Huiskes

[11] 3,995,540

[45] Dec. 7, 1976

[54] APPARATUS FOR STACKING, ALIGNING, AND DISCHARGING PAPERBOARD BLANKS

[75] Inventor: Martinus Christiaan Huiskes, Almelo, Netherlands

[73] Assignee: Koppers Company, Inc., Pittsburgh, Pa.

[22] Filed: July 1, 1975

[21] Appl. No.: 592,340

[30] Foreign Application Priority Data

July 10, 1974 Netherlands ..... 7409309

[52] U.S. Cl. ..... 93/93 DP; 93/93 R; 271/182; 271/202

[51] Int. Cl.[2] ..... B31B 1/98

[58] Field of Search ..... 93/93 C, 93 DP, 93 R, 93/93 D, 93 M; 271/202, 182, 183; 214/8.5 R, 8.5 SS, 6 R

[56] References Cited

UNITED STATES PATENTS

| | | | |
|---|---|---|---|
| 3,194,127 | 7/1965 | Larsson | 93/93 DP |
| 3,373,666 | 3/1968 | Crampton | 93/93 DP |
| 3,481,598 | 12/1969 | Lopez | 271/202 X |
| 3,547,024 | 12/1970 | Lopez | 271/202 X |
| 3,712,186 | 1/1973 | Lulie et al. | 93/93 C X |
| 3,908,527 | 9/1975 | Brockmüller et al. | 93/93 DP |

*Primary Examiner*—James F. Coan
*Attorney, Agent, or Firm*—Oscar B. Brumback

[57] ABSTRACT

Previously folded corrugated paperboard blanks are stacked, aligned, and discharged in stacks of preselected number by slowing the advance of such blanks advancing in serial alignment to form a stream of shingled blanks; counting a preselected number of the blanks; momentarily interrupting the stream in response to counting to form spaces between preselected numbers of the blanks; detecting the spaces; in response to such detecting, stopping and then releasing the preselected numbers of blanks for collection in a stack; simultaneously aligning all the blanks in the stack; and discharging the aligned stack perpendicular to the stream of shingled blanks. Suitable apparatus for performing the method includes a shingling conveyor having a first gate to form the spaces between preselected numbers of blanks; a detector for detecting the spaces; a second gate controlled by the detector to release the preselected number of blanks to form a stack on an inclined plate; and opposed, spaced belts for aligning and discharging the stacks perpendicular to the shingling conveyor.

8 Claims, 10 Drawing Figures

FIG. 6
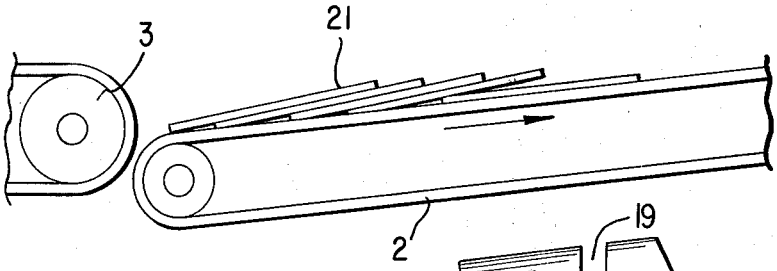
FIG. 7
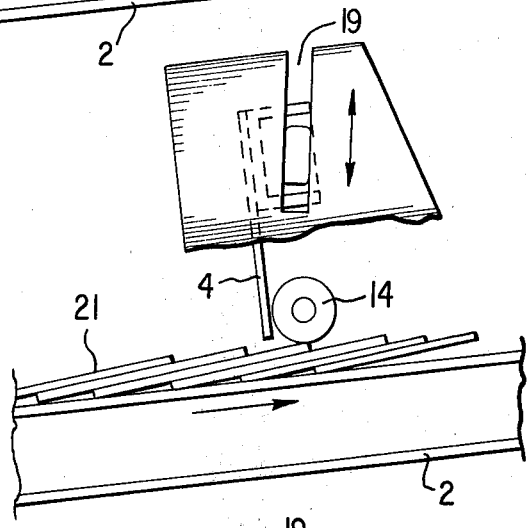
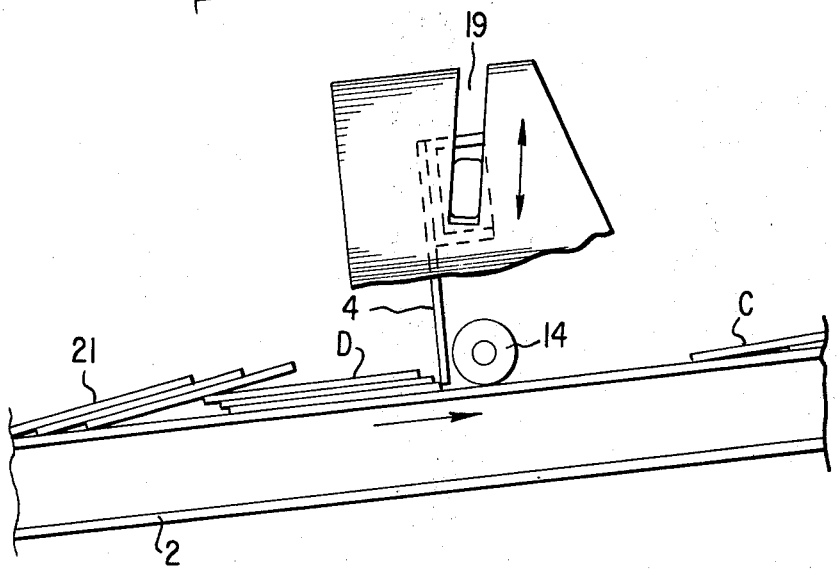
FIG. 8

APPARATUS FOR STACKING, ALIGNING, AND DISCHARGING PAPERBOARD BLANKS

BACKGROUND OF THE INVENTION

1. Field of the Invention

This invention relates generally to material or article handling and more particularly to article piling or arranging apparatus such as apparatus for stacking, aligning, and discharging folded corrugated paperboard blanks issuing from a folder-gluer machine.

2. Description of the Prior Art

Conventional folder-gluers are used to supply a stream of folded corrugated blanks in serial alignment with short spaces between the blanks. Examples of typical folder-gluers are shown in Spiess U.S. Pat. No. 2,637,251 and Lopez U.S. Pat. No. 3,266,391. The blanks issuing from the folder-gluer must be stacked in bundles, containing a preselected number of blanks, suitable for shipment to the user. It is usually necessary to square the blanks prior to bundling since they are not folded squarely in the folder.

The blanks are made from conventional corrugated paperboard consisting of four panels formed by slots and creases in the blanks. The blanks are folded about a center crease in the folder; glue is applied to an edge of one of the panels so that when the blank is folded, two of the panels overlap slightly and, when glued together, form a flat, tubular blank. The blanks are delivered flat to the user who opens and fills them with goods.

Since two of the panels are overlapped at the glue joint and the joint lies against another panel in the folded condition, it can be seen that three layers of material results whereas the remainder of the blank has only two thicknesses. This condition causes problems in stacking the blanks, particularly in automatic machines which have been developed for squaring and stacking the blanks. That is, stacks of such blanks tend to be unstable, particularly stacks of blanks of small sizes or unequal panel proportions.

Several automatic machines have been developed to square or align the folded blanks before or during the stacking operation. Generally, such machines square the blanks individually, it being understood that the glue joints are still tacky as the blanks are discharged from the folder-gluer. Examples of typical squaring and stacking machines are shown in Shields U.S. Pat. No. 2,988,236 and Lopez U.S. Pat. No. 3,122,242 and the aforementioned Spiess patent. Examples of improvements to such machines are shown in others of Shields' U.S. Pat. Nos. 2,931,520; 2,963,177; 3,409,148; 3,601,265; and 3,618,479.

Although considerable progress has been made in automatically squaring and stacking blanks for shipment, more exact alignment of the blanks is still sought along with greater accuracy in providing an exact preselected number of blanks in the final stacks.

Accordingly, a general object of the present invention is to improve the stacking and squaring of folded corrugated paperboard blanks and more particularly to overcome the disadvantages of existing machines to provide more exact alignment of the blanks and greater accuracy of the number of blanks desired in the final stacks.

SUMMARY OF THE INVENTION

The above and further objects and novel features are generally accomplished by the method of slowing the advance of the blanks issuing from a folder-gluer to form a stream of shingled blanks; counting a preselected number of the blanks issuing from the folder-gluer; momentarily interrupting the stream of shingled blanks in response to such counting to form spaces in the stream between the counted preselected number of blanks; detecting the spaces; stopping and then releasing the preselected numbers of blanks in response to detection of the spaces; stacking the preselected numbers of blanks following their release; simultaneously aligning all the blanks in the stack; and discharging the aligned stack in a direction perpendicular to the stream of shingled blanks.

Although various apparatus might be devised for achieving the foregoing method, the apparatus most suitable includes a shingling conveyor following the folder-gluer for receiving the blanks therefrom; a counter on the folder-gluer or on the shingling conveyor to signal the passage of a preselected number of blanks; a gate extending across the flow or stream of shingled blanks operable in response to the counter for momentarily interrupting the flow to form spaces in the stream between the preselected numbers of blanks; a detector for detecting the spaces; another similar gate operable in response to the detector for stopping and then releasing the preselected numbers of blanks in the stream; an inclined plate for receiving the blanks released by the last gate upon which a stack of preselected number of blanks is formed; a stop plate for stopping the advance of blanks falling upon the inclined plate; a fixed side plate opposite the stop plate for supporting the stack; and, a discharge means including a pusher for removing the stack from the inclined plate and a pair of spaced opposed belts for aligning and discharging the stacks from the machine.

The above method and apparatus results in more positive control of the blanks by maintaining them in overlapped or shingled relationship along the conveyor and in firm, stacked position following the conveyor; results in more accurate counting by separating the preselected numbers of blanks by spaces along the conveyor; and results in more exact squaring or aligning by squaring the blanks as a stack rather than individually.

The foregoing and further objects and novel features of the invention will appear more fully from the following detailed description when read in connection with the accompanying drawings, it being understood that the drawings are not intended to define the invention but are for the purpose of illustration only.

BRIEF DESCRIPTION OF THE DRAWINGS

In the drawings wherein like parts are marked alike:

FIG. 6 is a side elevation of the shingling conveyor of FIG. 1 showing the blanks advancing in shingled fashion along the shingling conveyor just after the folder-gluer;

FIG. 7 is a side elevation similar to FIG. 6 showing the blanks advancing along the shingling conveyor beneath the first gate assembly;

FIG. 8 is a side elevation similar to FIG. 7 showing the gate assembly in its engaged position for interrupting the flow of blanks to form spaces in the stream between preselected numbers of blanks;

DESCRIPTION OF THE PREFERRED EMBODIMENT

Figures 1, 2:
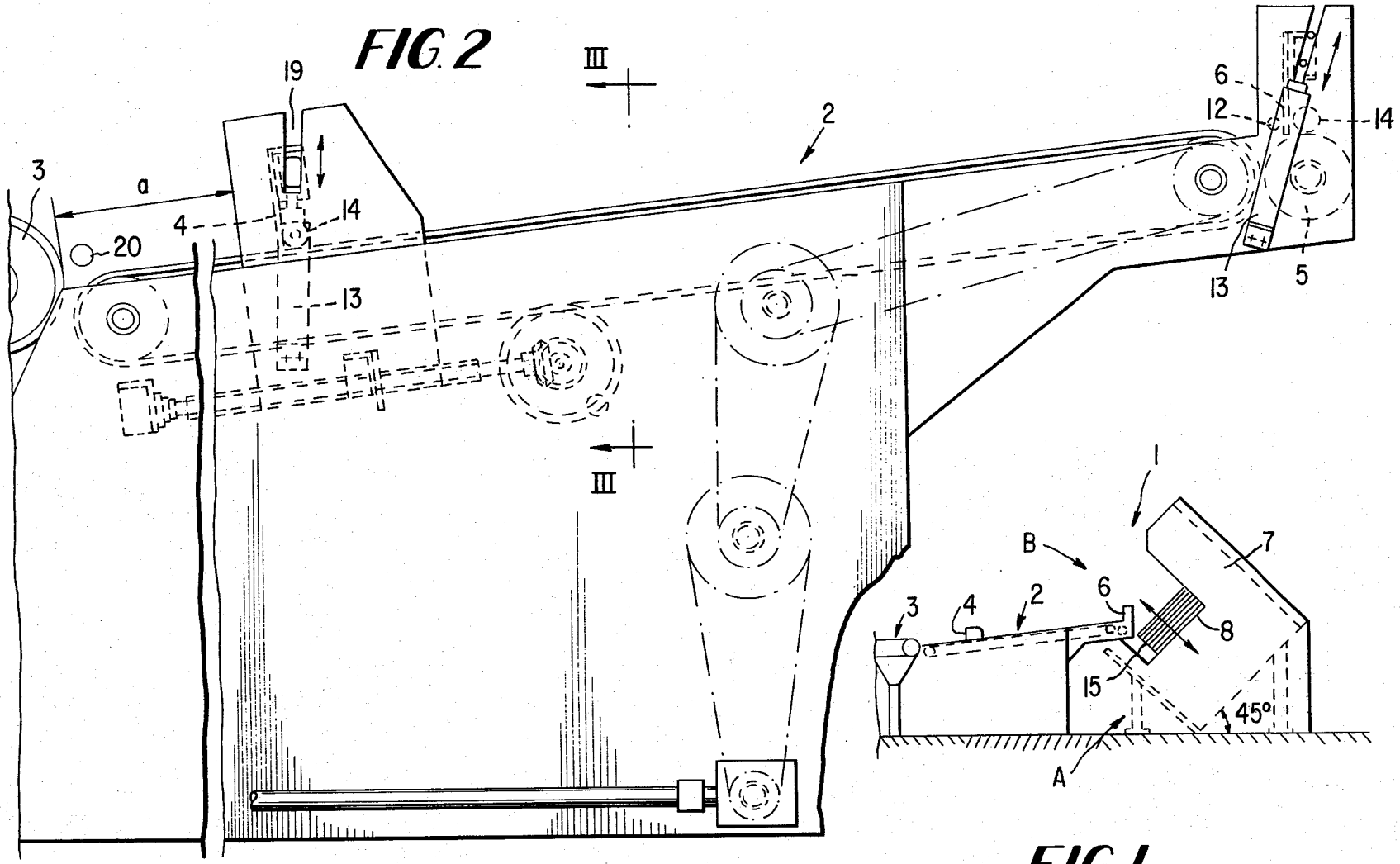
FIG. 1 is a schematic illustration in side elevation of the present invention showing the shingling conveyor, with the first and second gates, at the end of a folder-gluer and the inclined stacking, aligning, and discharge appartus at the end of the conveyor.
FIG. 2 is an enlarged schematic illustration showing the shingling conveyor of FIG. 1 in greater detail.

Referring now to FIG. 1, folded corrugated paperboard blanks issue in serial alignment, that is, with a small space therebetween, from the end of a folder-gluer machine 3 onto a shingling conveyor 2, the upstream end of which is lower than the end of the folder-gluer so that the blanks fall thereon. The shingling conveyor 2 is inclined upwardly slightly and runs at a speed slower than the speed of the blanks issuing from the folder 3 so that the blanks advance in shingled fashion along conveyor 2 as shown in FIG. 6. The blanks (numeral 21, FIG. 6) pass from conveyor 2 onto an inclined bottom support plate 8 in the stacking, aligning, and discharge assembly 7. Stacks of blanks are formed on plate 8 between an adjustable stop plate 16 and a fixed side plate 15. Thereafter, a pusher 9 (FIG. 9) pushes the stack, perpendicular to the direction of blanks moving along the shingling conveyor 2, between opposed, spaced belts 10 and 18 (FIG. 10) which align the stack and remove it from the machine onto another conveyor or table (not shown) where it may be tied in a bundle for shipment.

Figure 3:
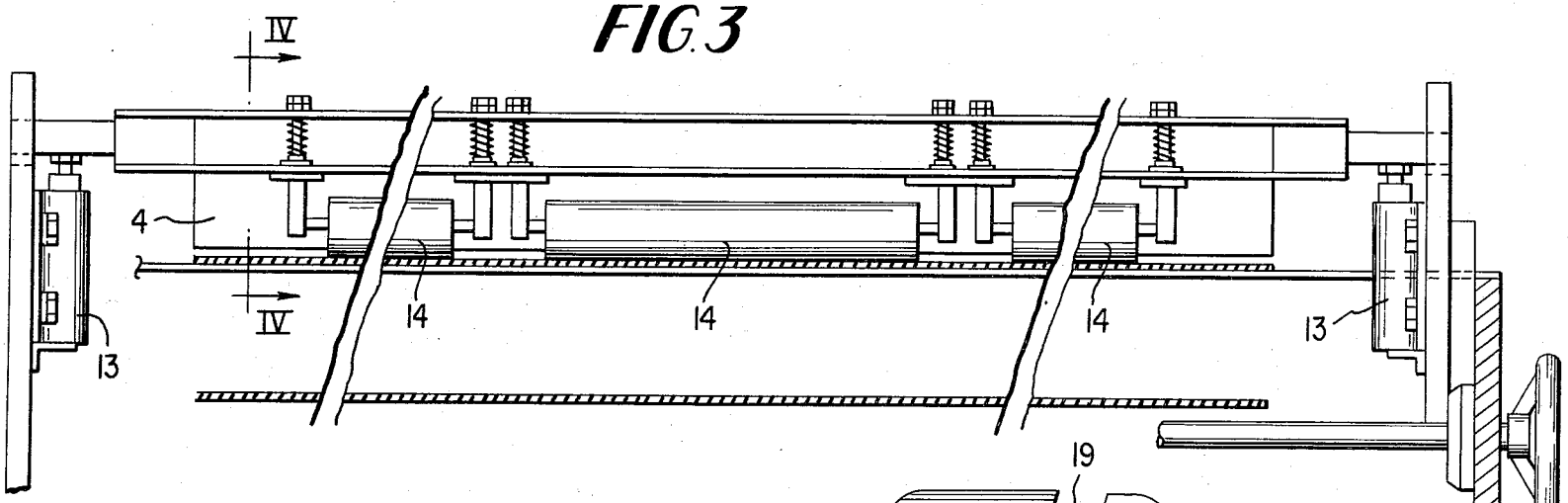
FIG. 3 is a front elevation of the first gate assembly taken along lines III—III of FIG. 2.

More specifically, shingling conveyor 2 includes a first gate assembly 4 and a second gate assembly 6 spaced along the conveyor as shown in FIG. 2. The gate assemblies 4 and 6 extend across the width of conveyor 2 as shown in FIG. 3. The gate 6 remains in a stationary position at the end of conveyor 2 but the gate assembly 4 is adjustable along the length of the conveyor to change the distance *a* (FIG. 2) between the end of the folder-gluer 3 and the gate 4. Distance *a* is made to be a little longer than the length of blanks 21 being processed for a particular order.

Both gate assemblies are movable from a disengaged position above conveyor 2 to an engaged position nearer the conveyor so as to engage blanks 21 as will be explained. Conventional pneumatically operated cylinders 13, mounted as shown in FIGS. 2 and 3, are used to move the gate assemblies 4 and 6 to and from their engaged and disengaged positions.

Figure 5:
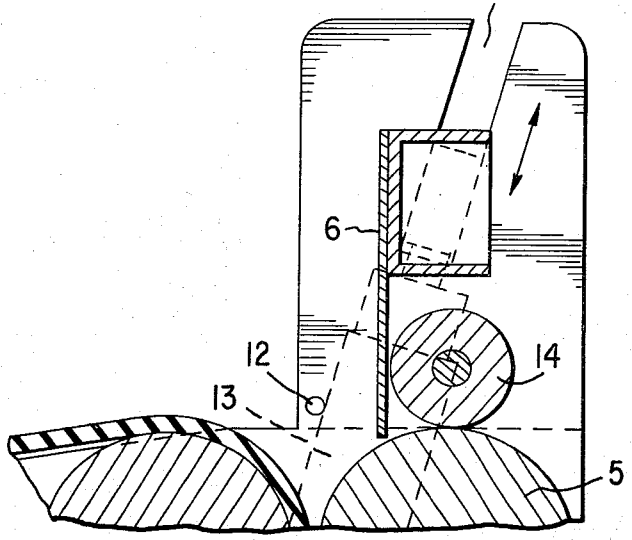
FIG. 5 is a side elevation similar to FIG. 4 of the second gate assembly.
Figure 4:
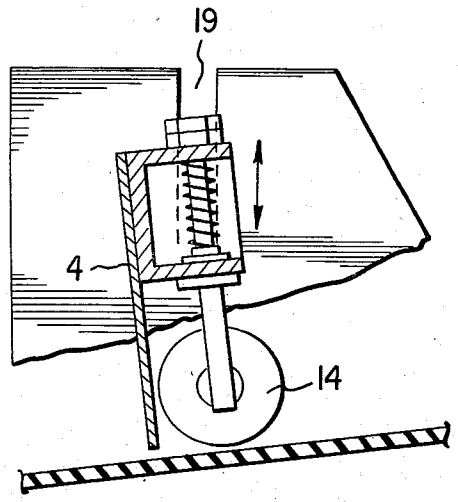
FIG. 4 is a side elevation of the first gate assembly taken along lines IV—IV of FIG. 3.

Gate assemblies 4 and 6 are similarly constructed, each including pressure rolls 14 (as shown in FIGS. 3, 4, and 5) behind, that is, downstream from the gates 4 and 6 which themselves are formed as transversely extending plates. Rolls 14 move upward and downward with gates 4 and 6 as the latter are moved from an upward disengaged position to a downward engaged position. In the upward position illustrated in FIG. 7, the plates 4 and 6 do not contact the blanks 21; however, rolls 14 are resiliently mounted as shown in FIG. 3 so that they extend slightly beneath the plates. Thus, rolls 14 roll across the tops of the blanks and keep them pressed against the belts of conveyor 2, beneath gate 4; however, as shown in FIG. 5, rolls 14 of gate 6 press the blanks against a driven support roll 5 to control the flow of blanks from conveyor 2 to the inclined plate 8.

A counter 20, schematically illustrated at the end of folder-gluer 3 in FIG. 2, such as a conventional electric eye actuated counter assembly, counts the blanks 21 advancing from the folder-gluer 3 onto shingling conveyor 2. At the beginning of a cycle, both gates 4 and 6 are in the upward disengaged position to permit passage of shingled blanks 21 beneath them. When a preselected number of blanks 21 (for example, 20 blanks) have passed, the counter 20 provides a signal to air cylinders 13 of gate 4 to lower the gate to its engaged position; simultaneously, the counter resets to zero to begin counting the next series of blanks. When the gate 4 is lowered, it contacts the leading edge of the, for example, twenty-first blank to halt its forward progress and the blanks following it. However, the twentieth blank "C", of the preceding series of the preselected number of blanks, is advanced by the pressure of rolls 14 urging it against the belts of conveyor 2. This sequence is illustrated in FIGS. 7 and 8 where the twenty-first and following blanks are denoted "D". Gate 4 remains in its downward engaged position for only a short time and thereafter returns to its upward disengaged position. As it moves upward, the twenty-first and subsequent blanks then pass beneath the gate and advance along the conveyor 2. Thus, it can be seen that gate 4 momentarily interrupts the stream of shingled blanks 21 to form spaces between the preselected numbers of blanks advancing in shingled fashion along conveyor 2.

The amount of overlap or shingling of blanks 21 on conveyor 2 should be held substantially constant to maintain proper control. Thus, the conveyor 2 is preferably driven from the folder-gluer 3 such as by a suitable conventional gear arrangement such as shown beneath gate 4 in FIG. 2. In this manner, the machines are synchronized and the shingling distance remains constant. It can also be seen that, to provide spaces of equal length between the preselected numbers of blanks regardless of the speed of the machine, the time that gate 4 must remain engaged will vary depending on the linear speed of the blanks and somewhat depending on the length of the blanks being processed. Such period of time may be automatically controlled by a conventional variable time delay circuit operative in conjunction with the counter 20.

It should also be observed, by reference to FIGS. 4 and 5, that gates 4 and 6 move both upward and away from, toward the downstream side, the leading edge of the blank being held to prevent binding of the blanks on the gates. This is accomplished by mounting the gates for movement in inclined slots 19, as illustrated in FIGS. 4 and 5, which are aligned at an angle with conveyor 2 as shown.

A detector 12 is located downstream from gate 4 and ahead of gate 6 as shown in FIG. 2. This detector may be a conventional electric eye capable of detecting the spaces between the preselected numbers of blanks on conveyor 2 and providing a signal to operate the air cylinders 13 for gate 6. Thus, as, for example, a first preselected number of blanks pass beneath gate 6, the detector will observe the space between such blanks and the next series of a preselected number of blanks and signal gate 6 to lower to its engaged position. Gate 6 is constructed similar to gate 4 as previously explained and operates in much the same manner, remaining in its engaged position for only a short period of time, being returned to its upward position by a signal from the stacking apparatus 7 as will be explained. Thus, it can be seen that gate 6, operating in response to detector 12, momentarily stops and then releases the preselected numbers of blanks advancing along conveyor 2. Gates 4 and 6 do not operate simultaneously but will operate in a rythmic relationship since gate 4 provides equal-length spaces in the stream of shingled blanks and the spaces advance at a uniform rate to where they are observed by detector 12 which, in turn, causes gate 6 to momentarily interrupt the flow of blanks while the preceding preselected number of blanks continue to advance into the stacking, aligning, and discharging apparatus 7. Thus, the synchronous operation of the folder-gluer 3 and shingling conveyor 2 along with rythmic operation of gates 4 and 6 assures the continuous supply of preselected numbers of blanks to apparatus 7.

As previously explained, the thickness of the folded blanks is not uniform and, if stacked vertically, tend to form an unstable stack which tends to tumble, especially if the blanks are short and piled too high, thus often resulting in jam-ups and interruptions in the process. To overcome such tendencies, this invention provides for stacking, aligning, and discharging the blanks at an angle rather than vertically as is usually done.

Figure 9:
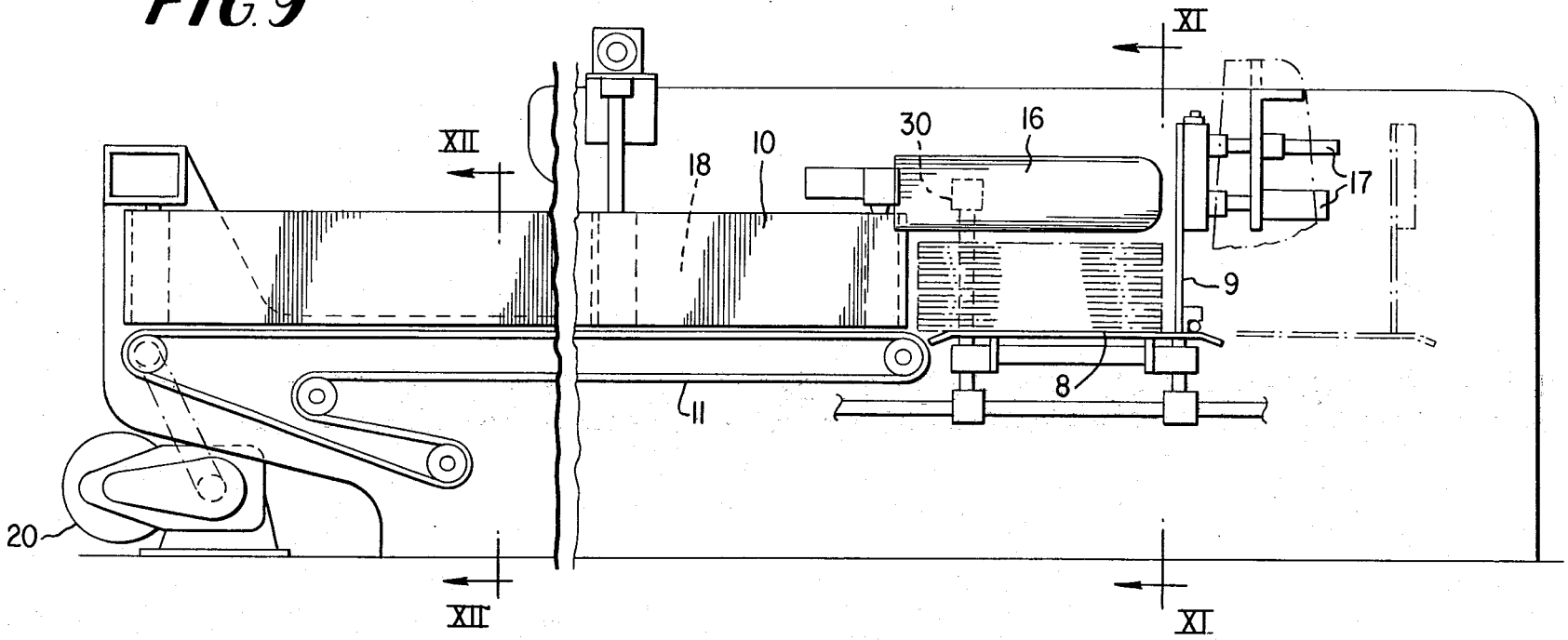
FIG. 9 is a front elevation of the stacking, aligning, and discharge apparatus looking in the direction of arrow A in FIG. 1.
Figure 10:
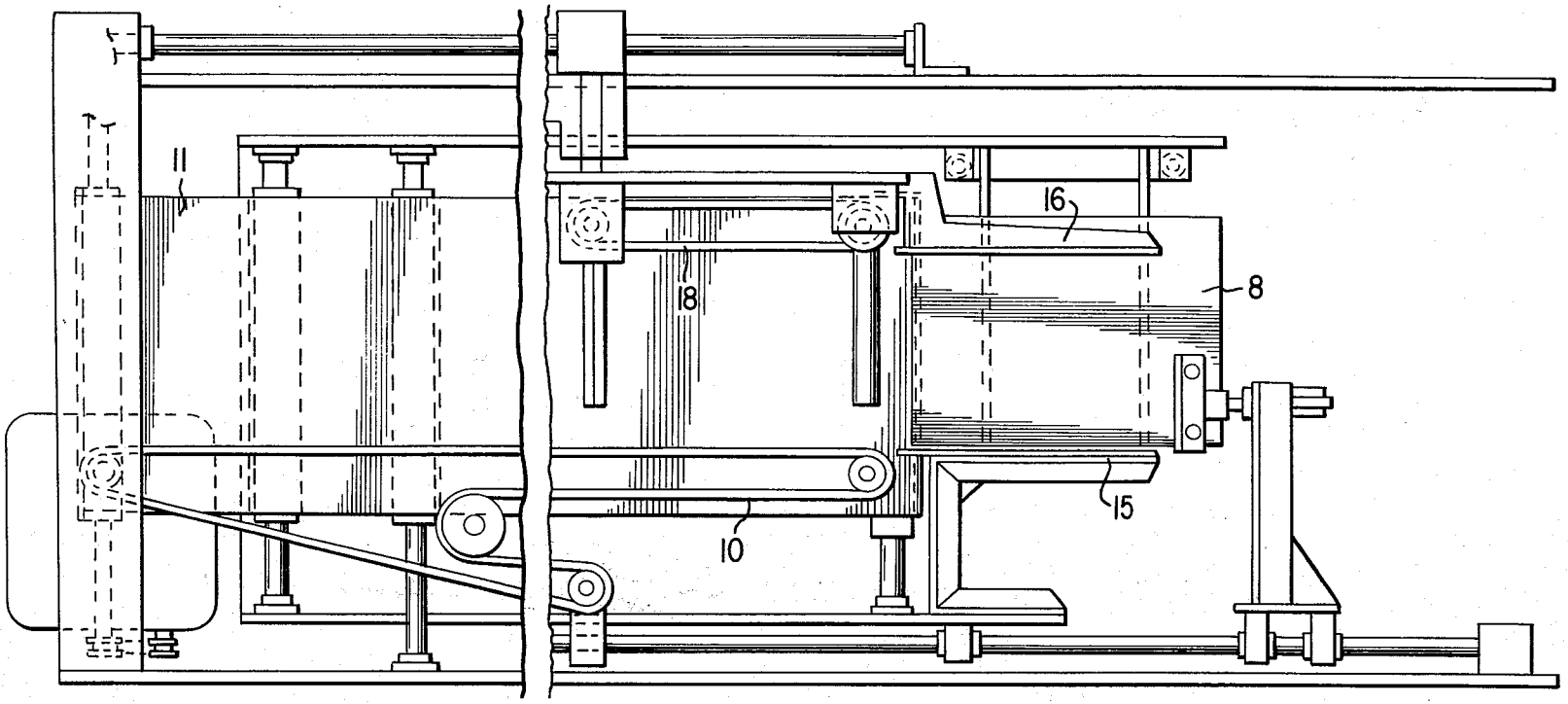
FIG. 10 is a front elevation similar to FIG. 9 of the stacking, aligning, and discharge apparatus looking in the direction of arrow B in FIG. 1.

Thus, as the blanks are discharged by the conveyor 2 between rolls 14 and driven pressure roller 5, they are first urged by their momentum against an adjustable stop plate 16 as shown in FIGS. 9 and 10. As the leading edges of the blanks hit plate 16, their trailing edges clear pressure roll 5 and drop beneath the level of conveyor 2.

The blanks fall downward against a bottom support plate 8 (FIG. 9) to form a stack of a preselected number of blanks thereon. The plate 8 is movable upward and toward the end of conveyor 2 at an angle shown by the double-ended arrow in FIG. 1. Assuming, for example, that the first blank of a stack to be formed is entering apparatus 7 from conveyor 2, plate 8 would be in the position of the top blank of the stack shown in FIG. 1. As blanks are subsequently added to the stack, the plate 8 is gradually lowered, so that each blank falls the same distance to the top of the stack, until it reaches its lowermost position. In this manner, the stack is controlled so that it does not tumble or otherwise become misaligned.

When the stack on the support plate 8 contains the number of blanks desired for a final stack, the stack is removed therefrom (as will be subsequently explained) and the plate 8 is automatically returned to its uppermost position to receive blanks for another stack. A detector (not shown), such as an electric eye, observes the first blank falling onto the plate 8 and causes the plate to gradually lower at a speed necessary to accommodate the rising height of the stack. The plate 8 may be lowered by a pneumatic cylinder 30 connected by suitable levers to the plate as will be understood by those skilled in the art.

At the time that the stack on plate 8 contains the desired number of blanks, it is automatically and rapidly lowered an additional short distance to its lowermost position, the stack is rapidly removed therefrom, and plate 8 rapidly returned to its upper position to receive the next preselected number of blanks, the foregoing sequence occurring while the next blanks are being held on conveyor 2 by gate 6. When plate 8 reaches its uppermost position, it trips a conventional electric limit switch (not shown) which signals cylinders 13 of gate 6 to raise the gate to release the next preselected number of blanks.

After the bottom plate 8 is quickly lowered to its lowermost position after formation of a complete stack thereon, as previously explained, the stack is removed from the plate by a pusher plate 9 as shown in FIG. 9. Conventional air cylinders 17 are actuated by plate 8 reaching its lowermost position and move pusher plate 9 rapidly to the left as viewed in FIG. 9 to move the stack onto conveyor belt 11. The stack is simultaneously pushed between the alignment conveyor belts 10 and 18 also shown in FIG. 10. After the stack is pushed on belt 11 and between belts 10 and 18, the pusher plate 9 returns automatically to its original position as best shown in FIG. 9. Pusher plate 9 is also adjustable to the right, as viewed in FIG. 9, to the dotted line position to accommodate blanks of greater width than those shown.

The bottom discharge belt 11 and alignment belts 10 and 18 are driven simultaneously at the same speed by motor 20. Belt 18 is adjustable in a conventional manner toward belt 10, which remains in a fixed position, to achieve a distance between the belts equal to the theoretical length of the blanks. Therefore, as the stack moves along belt 11 between belts 10 and 18, the blanks in the stack that may be misaligned are squeezed between the belts to align the blanks. At this time, the glue joints of the blanks are tacky which permits the blanks to be forcefully aligned but remain aligned after they pass between belts 10 and 18. Thus, all of the blanks in the stack are aligned simultaneously. Excellent control of the stack is maintained since the stack is restrained on three of its sides by belts 11, 10 and 18 thereby overcoming any tendency of the stack of tumble or otherwise jam up the machine.

Discharge of the aligned stack from the machine is accomplished by belts 11 and 10, belt 11 being on the same plane with and in effect an extension of bottom plate 8. Since belt 10 serves to discharge the stack after alignment between it and belt 18, belt 10 is longer than belt 18, extending coextensive with the length of belt 11. Thus, as the stack passes belt 18, it continues to be moved by belts 11 and 10. Since these belts are aligned with the bottom plate 8 and fixed plate 15, as previously explained, it can be seen that the stack is maintained at an angle to horizontal as shown in FIG. 1. Therefore, the bottom of the stack rests on belt 11 and one side rests against belt 10. This arrangement overcomes any tendency of the stack to topple and firm control of the stack is maintained.

When the stack reaches the end of belts 10 and 11, it may be manually removed or, if desired, may be discharged onto a table or conventional conveyor (not shown) where it may be tied in a bundle for shipment.

In summary, the operation of the apparatus has been explained along with the description of the apparatus and no further explanation is believed necessary. Accuracy of the number of blanks in the final stack is achieved by creating spaces between the counted, preselected numbers of shingled blanks along the shingled conveyor and subsequently stopping and releasing such prselected numbers of blanks for discharge into the stacking apparatus. Firm control of the blanks is maintained at all times by shingling the blanks on the conveyor and thereafter stacking them at an angle while they are being restrained on three sides of the stacks. Improved alignment is achieved by aligning all the blanks in the stack simultaneously.

Thus, the invention, having been described in its best embodiment and mode of operation, that is desired to claimed by Letters Patent is:

1. Apparatus for stacking, aligning, and discharging folded corrugated paperboard blanks comprising:

a conveyor means, operable in synchronism with blank advancing apparatus, for receiving blanks advancing faster than said conveyor means to form a stream of uniformly shingled blanks thereon;

a first gate means on said conveyor means for momentarily interrupting the advance of said blanks to form spaces between preselected numbers of blanks downstream from said first gate means, and first gate means including:

a. a first plate means extending across the width of said conveyor means;

b. a first pneumatic means, operable in response to a preselected number of blanks advancing onto said conveyor means, for moving said first plate means from a disengaged position above said conveyor means to an engaged position for contact with the leading edge of one of said blanks; and c. a first roller means, secured behind said first plate means and movable therewith, for advancing the blanks preceding said one blank to form said spaces between said preselected numbers of blanks;

said first gate means being adjustable along the length of said conveyor means for accommodating the length of blanks being advanced onto said conveyor means and said first pneumatic means interrupting the advance of said blanks for a period of time proportional to the speed of said conveyor means;

a detector means on said conveyor means downstream from said first gate means for detecting said spaces;

a second gate means on said conveyor means, downstream from and adjacent to said detector means and responsive thereto for momentarily stopping the advance of and thereafter releasing said preselected numbers of blanks, said second gate means including:

a. a second plate means extending across the width of said conveyor means;

b. a second pneumatic means, operable in response to said detector means detecting a space between said preselected numbers of blanks, for moving said second plate means from a disengaged position above said conveyor means to an engaged position for contact with said preselected numbers of blanks advancing from said first gate means; and c. a second roller means, secured behind said second plate means in cooperative engagement with a lower roller means on said conveyor means, for advancing said preselected numbers of blanks released by said second plate means;

and stacking, aligning, and discharge means adjacent the downstream end of said conveyor means for receiving said preselected numbers of blanks released by said second gate means to form stacks of blanks of preselected number, simultaneously align all the blanks in such stacks, and discharge the same in a direction perpendicular to the advance of said shingled blanks along said conveyor means.

2. The apparatus of claim 1 wherein said stacking, aligning, and discharge means includes a bottom support plate movable from an upper position, adjacent to a discharge end of said conveyor means behind said second gate means, to a lower position corresponding to the height of a stack of blanks formed thereon for maintaining substantially constant the height each blank in said stack must fall when received by said stacking, aligning, and discharge means from said conveyor means.

3. The apparatus of claim 2 wherein said bottom support plate is inclined in a direction corresponding to the advance of blanks along said conveyor means such that the leading edges of blanks entering said stacking, aligning, and discharge means rise above the level of said discharge end of said conveyor means and the trailing edges of said blanks fall below said level.

4. The apparatus of claim 3 wherein said stacking, aligning, and discharge means includes:

stop plate means for stopping the advance of blanks received from said conveyor means; and fixed side plate means, opposite said stop plate means and spaced therefrom a distance substantially equal to the width of said blanks, against which said blanks are supported along with said bottom support plate.

5. The apparatus of claim 4 wherein said stacking, aligning, and discharge means includes pusher means for removing stacks of blanks from said bottom support plate in a direction perpendicular to the advance of said blanks along said conveyor means.

6. The apparatus of claim 5 wherein said stacking, aligning, and discharge means includes spaced alignment means laterally adjacent said bottom support plate for receiving stacks of blanks, removed from said bottom support plate by said pusher means, and simultaneously aligning the blanks in said stacks.

7. The apparatus of claim 6 wherein said spaced alignment means includes a first belt means in alignment with said stop plate means and a second belt means in alignment with said fixed side plate means for receiving said stacks removed from said bottom support plate by said pusher means, aligning the blanks in said stacks, and discharging said stacks from said stacking, aligning, and discharge means.

8. The apparatus of claim 7 wherein said stop plate means and said first belt means are adjustable towards said fixed side plate means and said second belt means respectively for accommodating the length of blanks being received in said stacking, aligning, and discharge means from said conveyor means.

* * * * *